US006688858B1

(12) United States Patent
Boone et al.

(10) Patent No.: US 6,688,858 B1
(45) Date of Patent: Feb. 10, 2004

(54) PUMP HOUSING MOUNTING FLANGE WITH TANGENTIALLY POSITIONED MOUNTING SLOTS

(75) Inventors: Nick Boone, Ames, IA (US); Larry Walker, Ames, IA (US); David Dirks, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 21 days.

(21) Appl. No.: 10/217,780

(22) Filed: Aug. 13, 2002

(51) Int. Cl.[7] ..... F04B 17/00; F01B 29/00
(52) U.S. Cl. ..... 417/360; 417/269; 92/128
(58) Field of Search ..... 417/360, 269; 92/128, 146, 161; 403/348

(56) References Cited

U.S. PATENT DOCUMENTS

| | | | | |
|---|---|---|---|---|
| 253,482 A | | 2/1882 | Mixer | |
| 3,306,220 A | * | 2/1967 | Dahlgren et al. | 417/360 |
| 4,185,334 A | | 1/1980 | Izzi | |
| 4,211,519 A | * | 7/1980 | Hogan | 417/360 |
| 4,311,440 A | * | 1/1982 | Eberhardt | 417/360 |
| 4,437,816 A | * | 3/1984 | Magee et al. | 417/465 |
| 4,494,666 A | | 1/1985 | Cooper et al. | |
| 5,401,146 A | | 3/1995 | Morlya et al. | |
| 5,897,300 A | * | 4/1999 | Luedtke | 417/477.9 |
| 6,161,727 A | | 12/2000 | Gordon et al. | |
| 6,328,538 B1 | | 12/2001 | Rademacher | |

* cited by examiner

*Primary Examiner*—Justine R. Yu
*Assistant Examiner*—Michael K. Gray

(57) ABSTRACT

A pump housing assembly includes a housing, a hub portion, and a flange. The housing has an end cowling defining a transition from a central portion of the housing to a transverse end portion. The hub portion extends longitudinally outwardly from the transverse end portion of housing. The flange extends radially outwardly from the outward end of the hub and is in spaced longitudinal relation to the end of the cowling to create a space to receive a head of a mounting bolt. The flange has an outer periphery with a pair of tangentially extending slots having an open end. The space for receiving a head of a mounting bolt is less than the length of a shank of a mounting bolt, to minimize the length of the housing. The slots have a width sufficient to receive the movement of a shank into and out of the open ends of the slots.

4 Claims, 4 Drawing Sheets

PUMP HOUSING MOUNTING FLANGE WITH TANGENTIALLY POSITIONED MOUNTING SLOTS

BACKGROUND OF THE INVENTION

Mounting flanges fitted to machine fixtures are often used to connect the machine fixtures to mounting plates or other objects. These machine fixtures have housings to encase the operational components of the fixtures. Typically, the bolt holes of the mounting flanges are radially located beyond the circumference of the machine fixture housing. This allows for easy access to the bolt holes for insertion of bolt, and easy access to the bolt heads for tightening.

However, in applications with space restrictions, this arrangement of the bolt holes being radially located beyond the circumference of the machine fixture housing results increases the overall diameter of the machine fixtures fitted with a mounting flange, thereby restricting the available room for the machine fixture housing.

Alternatively, the bolt holes may be located within the circumference of the machine fixture housing. In this case, the flange must be located far enough from the housing to allow the bolt to fit between the housing and the flange, so the bolt may slide into the flange bolt holes. This arrangement has the benefit of reducing the radius of the mounting flange.

However, in applications with space restrictions, this arrangement of the bolt holes being located within the circumference of the machine fixture housing increases the overall length of the machine fixtures fitted with a mounting flange, thereby restricting the available room for the machine fixture housing.

Therefore, a principal object of this invention is to provide a housing mounting flange which effectively decreases the effective length of a pump housing while facilitating its connection to a supporting structure.

A further object of the invention is to provide a pump housing assembly capable of being rotatably engaged with bolts located in a mounting surface.

These and other objects will be apparent to those skilled in the art.

SUMMARY OF THE INVENTION

A pump housing assembly mounting flange includes a housing, a hub portion, and a flange. The housing has an end cowling defining a transition from a central portion of the housing to a transverse end portion. The hub portion extends longitudinally outwardly from the transverse end portion of housing. The flange extends radially outwardly from the outward end of the hub and is in spaced longitudinal relation to the end of the cowling to create a space to receive a head of a mounting bolt. The flange has an outer periphery with a pair of tangentially extending slots having an open end. The space for receiving a head of a mounting bolt is less than the length of a shank of a mounting bolt, to minimize the length of the housing. The slots have a width sufficient to receive the movement of a shank into and out of the slots open ends.

DESCRIPTION OF THE PREFERRED EMBODIMENT

Figure 1:
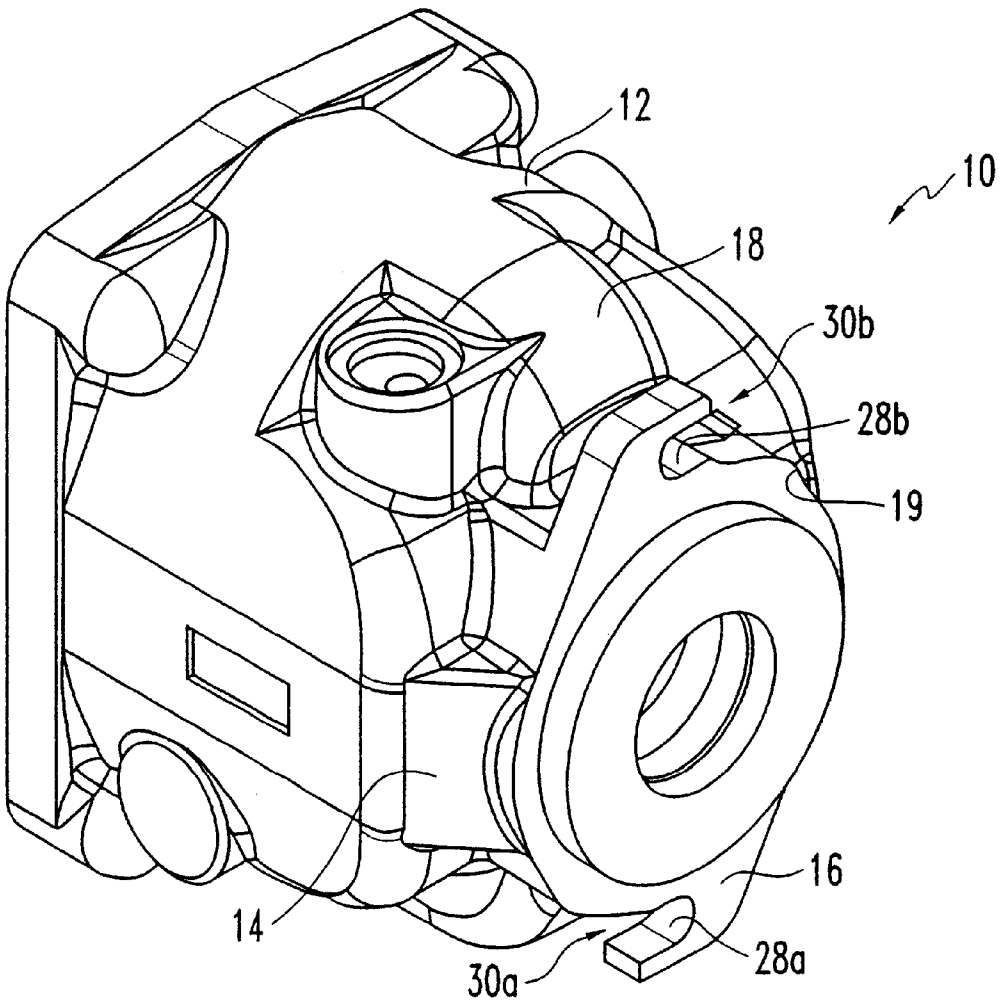
FIG. 1 is a perspective view of the device of this invention.

With reference to FIG. 1, a pump housing assembly 10 or the like includes a housing 12, hub 14, and a mounting flange 16. The housing 12 has a longitudinal axis 13 and an end cowling 18 defining a transition from a central portion of the housing to a transverse end portion. The hub portion 14 extends longitudinally outwardly from the transverse end portion of housing 12 and has a rounded shoulder 19.

Figure 2:
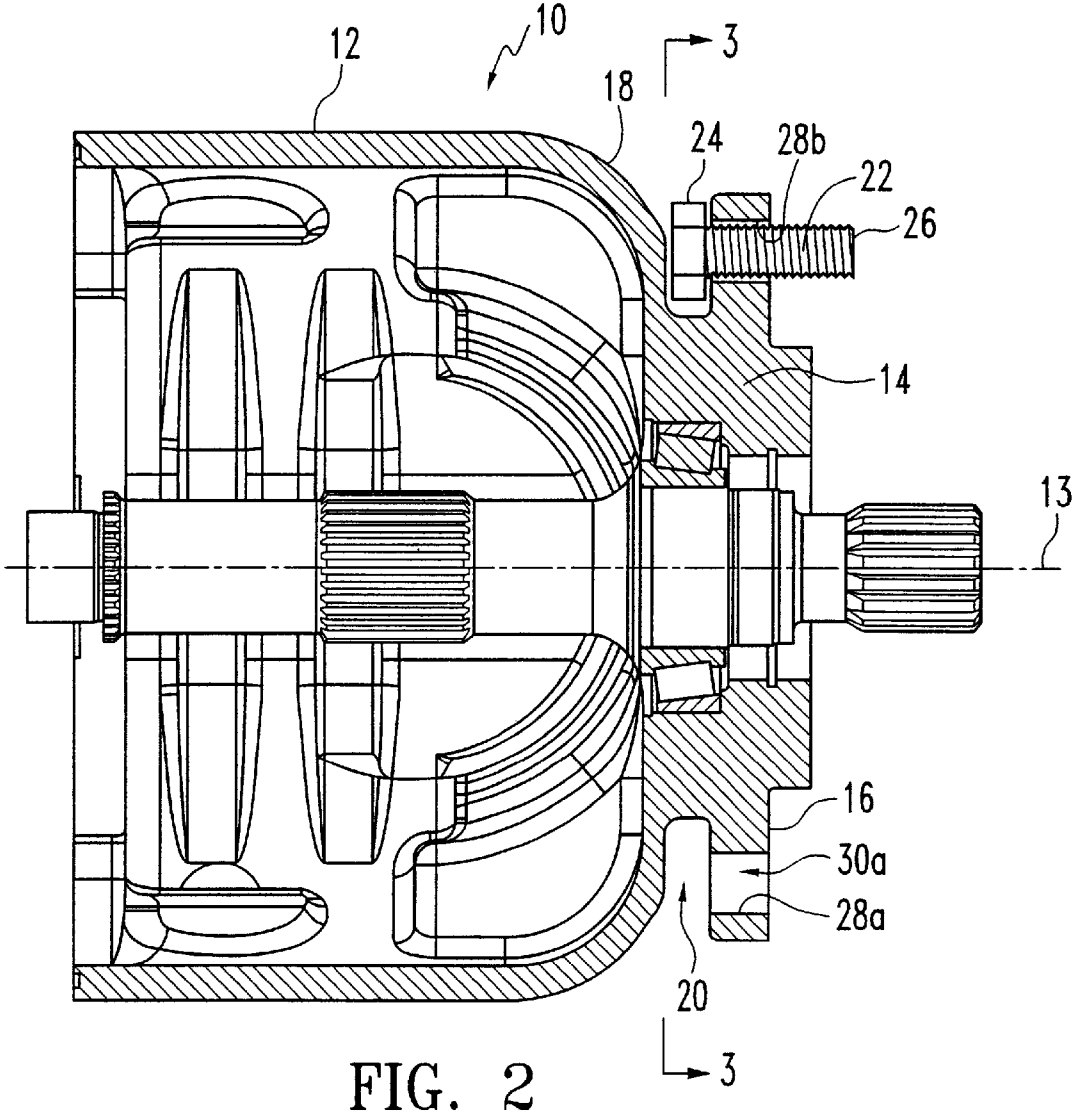
FIG. 2 is a sectional side view of the device of this invention.

Referring to FIG. 2, the flange 16 extends radially outwardly from the outward end of the hub 14 and is in spaced longitudinal relation to the end of the cowling 18 to create a space 20. The space 20 created between the flange 16 and the end of the cowling 18, receives a head 24 of a mounting bolt 22. The space 20 is less than the length of a shank 26 of a mounting bolt 22. The limitation in size of the space 20 minimizes the length of the pump housing assembly 10.

Referring again to FIG. 1, the flange 16 has an outer periphery with a pair of tangentially extending slots 28*a* and 28*b* having open ends 30*a* and 30*b*, respectively. The slots 28*a* and 28*b* have a width sufficient to receive the movement of a shank 22 into and out of the open ends 30*a* and 30*b* of the slots.

Figure 3:
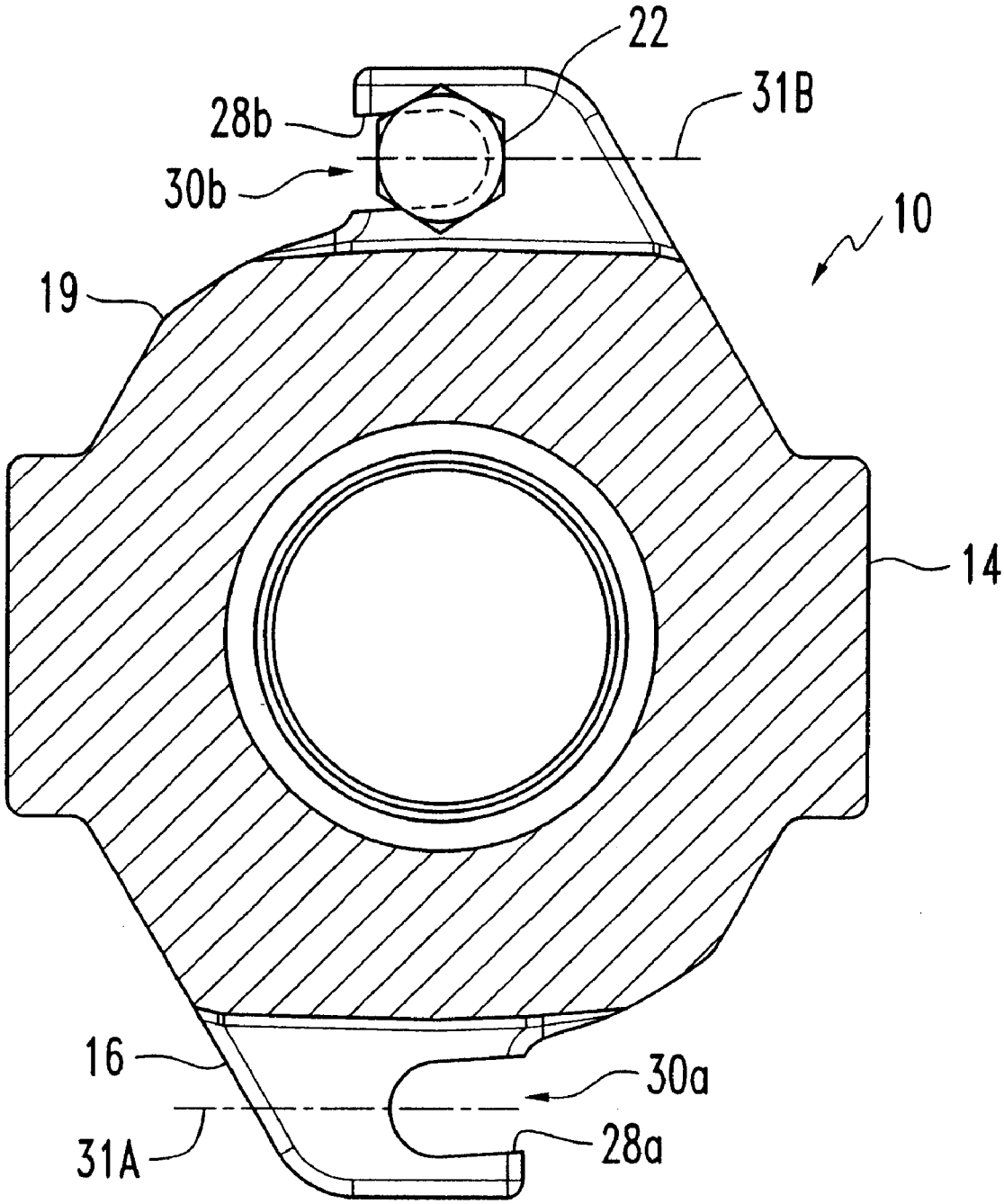
FIG. 3 is a transverse sectional view of the device of this invention taken on line 3—3 of FIG. 2.
Figure 4:
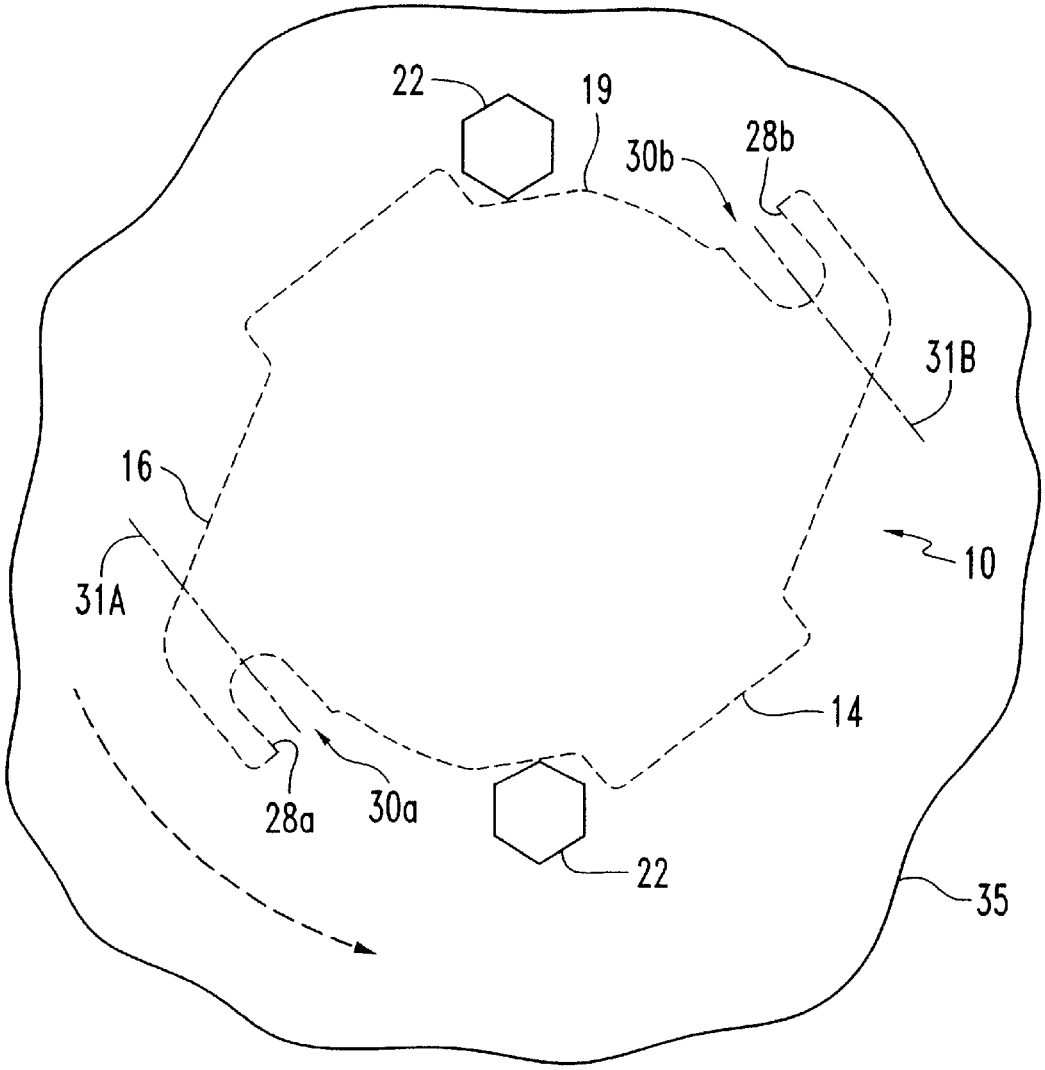
FIG. 4 is a transverse sectional view of the device of this invention taken on line 3—3 of FIG. 2 superimposed on a substrate.

With reference to FIGS. 3 and 4, the open ends 30*a* and 30*b* of the pair of tangentially extending slots 28*a* and 28*b* face opposing directions. Further, each slot 28*a* and 28*b* has a center axis 31A and 31B, respectively, which extends in a substantially tangential direction with respect to the longitudinal axis 13 of the housing 12. This allows for the pump housing assembly 10 to be placed flush to a mounting surface 35 and rotationally engaged with bolts 22 located in the mounting surface 35.

With reference to FIGS. 4, during installation the pump housing assembly 10 is placed flush to a mounting surface 35 and rotatably engaged with bolts 22 located in the mounting surface 35. The rounded shoulder 19 of hub 14 allows the rotation of the pump housing assembly 10 to avoid impact with the bolts 22. Once the bolts 22 are engaged, they may be tightened to secure the pump housing assembly 10 to the mounting surface 35.

It is therefore seen that the present invention having open ends 30*a* and 30*b* in the pair of tangentially extending slots 28*a* and 28*b* effectively shortens the pump housing assembly 10 since only enough clearance is needed for the bolt head 24 to pass into space 20 between the housing 12 and the back of flange 16 (and any necessary tolerances). This arrangement also effectively decreases the size of the pump housing assembly 10 in a transverse direction. Additionally, this arrangement allows the pump housing assembly 10 to be placed flush to a mounting surface 35 and rotatably engaged with bolts 22 located in the mounting surface 35.

It is therefore seen that this invention will accomplish at least all of its stated objectives.

We claim:

1. A pump housing assembly, comprising:

a housing for operational components having an end cowling defining a transition from a central portion of the housing to a transverse end portion;

a hub portion on the transverse end portion and extending longitudinally outwardly from the housing;

a mounting flange on an outward end of the hub and extending radially outwardly therefrom and being in spaced longitudinal relation to the end of the cowling to create a space to receive a head of a mounting bolt;

the mounting flange having an outer periphery with a pair of slots having an open end therein;

the space for receiving a head of a mounting bolt being less than the length of a shank of a mounting bolt extending from the head longitudinally through the slots and outwardly from the mounting flange to minimize the length of the housing; and the slots having a width sufficient to receive the movement of a shank of a mounting bolt into and out of the slots through the open ends thereof.

2. The pump housing assembly of claim 1, wherein the open ends of the pair of radial slots face opposing directions.

3. The pump housing assembly of claim 1, wherein each slot has a center axis which extends in a substantially tangential direction with respect to a longitudinal axis of the housing.

4. The pump housing assembly of claim 2, wherein each slot has a center axis which extends in a substantially tangential direction with respect to a longitudinal axis of the housing.

* * * * *